US008070382B2

(12) United States Patent
Prinz

(10) Patent No.: US 8,070,382 B2
(45) Date of Patent: Dec. 6, 2011

(54) INTERLOCKING RUBBER TILES FOR PLAYGROUNDS

(75) Inventor: George Prinz, Saugerties, NY (US)

(73) Assignee: Unity Creations, Ltd., Saugerties, NY (US)

( * ) Notice: Subject to any disclaimer, the term of this patent is extended or adjusted under 35 U.S.C. 154(b) by 0 days.

(21) Appl. No.: 12/799,784

(22) Filed: Apr. 30, 2010

(65) Prior Publication Data

US 2010/0275541 A1 Nov. 4, 2010

Related U.S. Application Data

(60) Provisional application No. 61/215,087, filed on May 1, 2009, provisional application No. 61/279,975, filed on Oct. 28, 2009.

(51) Int. Cl.
*E01C 5/18* (2006.01)

(52) U.S. Cl. ..... 404/35; 404/41

(58) Field of Classification Search ..... 404/35, 404/40, 41; 52/177
See application file for complete search history.

(56) References Cited

U.S. PATENT DOCUMENTS

| | | | | |
|---|---|---|---|---|
| 2,282,559 | A * | 5/1942 | Byers | 52/582.1 |
| 5,971,655 | A * | 10/1999 | Shirakawa | 404/40 |
| 6,769,835 | B2 * | 8/2004 | Stridsman | 404/41 |
| 7,021,012 | B2 * | 4/2006 | Zeng et al. | 52/177 |
| 7,114,298 | B2 * | 10/2006 | Kotler | 52/177 |
| 7,131,161 | B2 * | 11/2006 | Lee | 14/73 |
| 7,331,147 | B2 * | 2/2008 | Kalisiak et al. | 52/385 |
| 7,571,572 | B2 * | 8/2009 | Moller, Jr. | 52/177 |
| 7,591,605 | B2 * | 9/2009 | Jonasz et al. | 404/15 |

* cited by examiner

*Primary Examiner* — Gary S Hartmann
(74) *Attorney, Agent, or Firm* — Gerald T. Bodner

(57) ABSTRACT

A tile for covering an area and which interlocks with an adjacent tile includes a main body having a top surface and a bottom surface disposed opposite the top surface. The main body has at least a first lateral side and a second lateral side. The tile includes at least one male connector situated on at least one of the first lateral side and the second lateral side of the main body and extending outwardly therefrom. The tile further includes at least one female receptacle situated on at least one of the first lateral side and the second lateral side of the main body and extending outwardly therefrom. The male connector of the tile is engageable with a female receptacle of an adjacent tile so that the tile may interlock with the adjacent tile.

11 Claims, 6 Drawing Sheets

Fig. 1
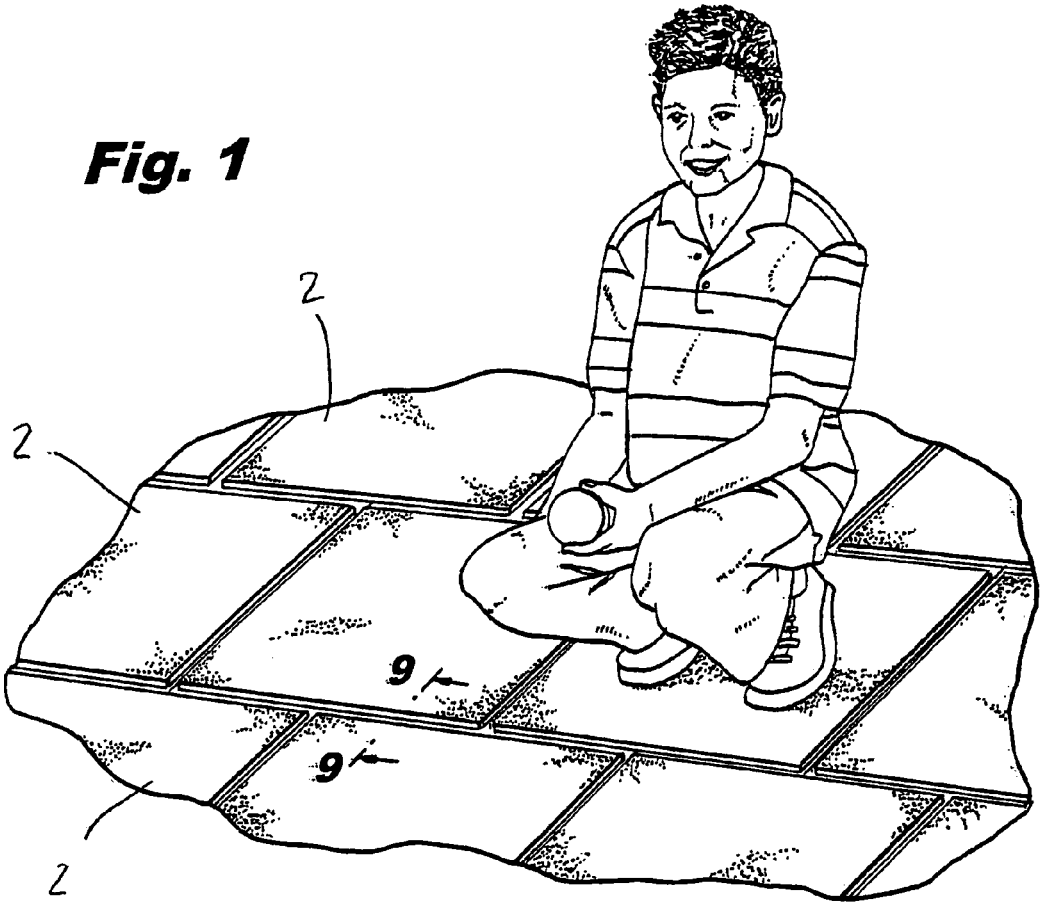
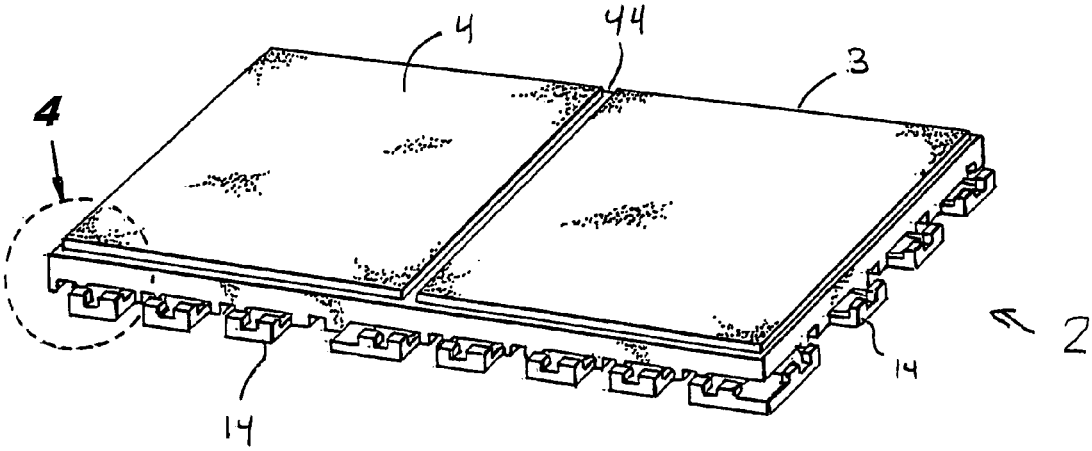
Fig. 2

INTERLOCKING RUBBER TILES FOR PLAYGROUNDS

CROSS-REFERENCE TO RELATED APPLICATIONS

This application is related to U.S. Provisional Application Ser. No. 61/215,087, which was filed on May 1, 2009, and is entitled "Interlocking Rubber Tiles For Playgrounds", and U.S. Provisional Application Ser. No. 61/279,975, which was filed on Oct. 28, 2009, and is entitled "Interlocking Rubber Tiles For Playgrounds", the disclosure of each of which is hereby incorporated by reference and on which priority is hereby claimed.

BACKGROUND OF THE INVENTION

1. Field of the Invention

This invention generally relates protective padding and more particularly relates to recycled protective tiling.

2. Description of the Prior Art

The most common injuries at recreational facilities such as playgrounds and sporting arenas are attributed to falls. Such injuries include head trauma, fractures and sprains, some leaving long term disability. Children very often run on concrete slabs or loose gravel, while others play on swings, carrying them high above the ground. During incidents in which the child loses control or balance, the ground material can prove to be very unforgiving.

Conventional methods of minimizing injury from falls include padding the ground with dense material such as closed cell foam. This type of padding commonly comes in lengthy sheets that are cut to size. The sheets are placed over the ground, regardless of the composition. For example, closed cell foam pads are often placed over loose gravel in the same manner that they are placed over concrete slab. Unfortunately, the underlying ground material can affect the overall effectiveness of the protective padding.

Closed cell foam pads most typically have a planar bottom and top without any recesses. While this conventional design provides means for effectively positioning and maintaining coverage of a concrete slab, if the same foam pad is placed on loose gravel or rocks, it will not be secured and may cause further personal injury from movement of the protective covering. Additionally, when closed cell foam pads are placed on uneven surfaces such as gravel, the foam pads take the shape of the underlying surface, creating an uneven activity area that may provoke falls from tripping. Conventional closed cell foam padding also tends to become slippery when wet from inclement weather or nearby sprinklers as water commonly pools on the flat surface thereof.

There are also conventional tiles available that are made from reprocessed or recycled rubber, for example, from shredded rubber automobile tires. However, such conventional tiles do not interlock with one another and may separate, or buckle, leaving either an exposed area of the supporting surface on which the tiles are laid, or an uneven surface, which may cause injury to a child playing on the tiled surface.

The present invention provides a novel rubberized padding device that overcomes the inherent disadvantages found in the conventional designs.

OBJECTS AND SUMMARY OF THE INVENTION

It is an object of the present invention to provide rubberized tiles for use in covering sports and recreational areas or the like which interlock with one another.

It is another object of the present invention to provide rubberized, interlocking tiles which include structure that acts as a reservoir for containing glue to adhesively join adjacent tiles together.

It is still another object of the present invention to provide rubberized tiles which interlock with one another, and which include structure that acts as a reservoir for containing glue to adhesively join adjacent tiles together, and further include structure that allows excess glue to be removed from the reservoir.

It is yet another object of the present invention to provide interlocking tiles for use with playgrounds, rooftop surfaces and the like made from reprocessed or recycled rubber which overcome the inherent disadvantages of known tiles.

In accordance with one form of the present invention, a tile for covering an area and which interlocks with an adjacent tile includes a main body having a top surface and a bottom surface disposed opposite the top surface. The main body has at least a first lateral side and a second lateral side.

The tile includes at least one male connector situated on at least one of the first lateral side and the second lateral side of the main body and extending outwardly therefrom. The tile further includes at least one female receptacle situated on at least one of the first lateral side and the second lateral side of the main body and extending outwardly therefrom.

The male connector of the tile is engageable with a female receptacle of an adjacent tile so that the tile may interlock with the adjacent tile.

Preferably, the male connector and the female receptacle include structure defining a reservoir for containing an adhesive for adhesively securing the tile and an adjacent tile together.

These and other objects, features and advantages of the present invention will be apparent from the following detailed description of illustrative embodiments thereof, which is to be read in connection with the accompanying drawings.

BRIEF DESCRIPTION OF THE DRAWINGS

FIG. 1 is a perspective view of the interlocking tiles of the present invention joined together to form a protective surface for playgrounds and the like.

FIG. 2 is a perspective view of the tile formed in accordance with the present invention.

DETAILED DESCRIPTION OF THE PREFERRED EMBODIMENTS

Figure 3:
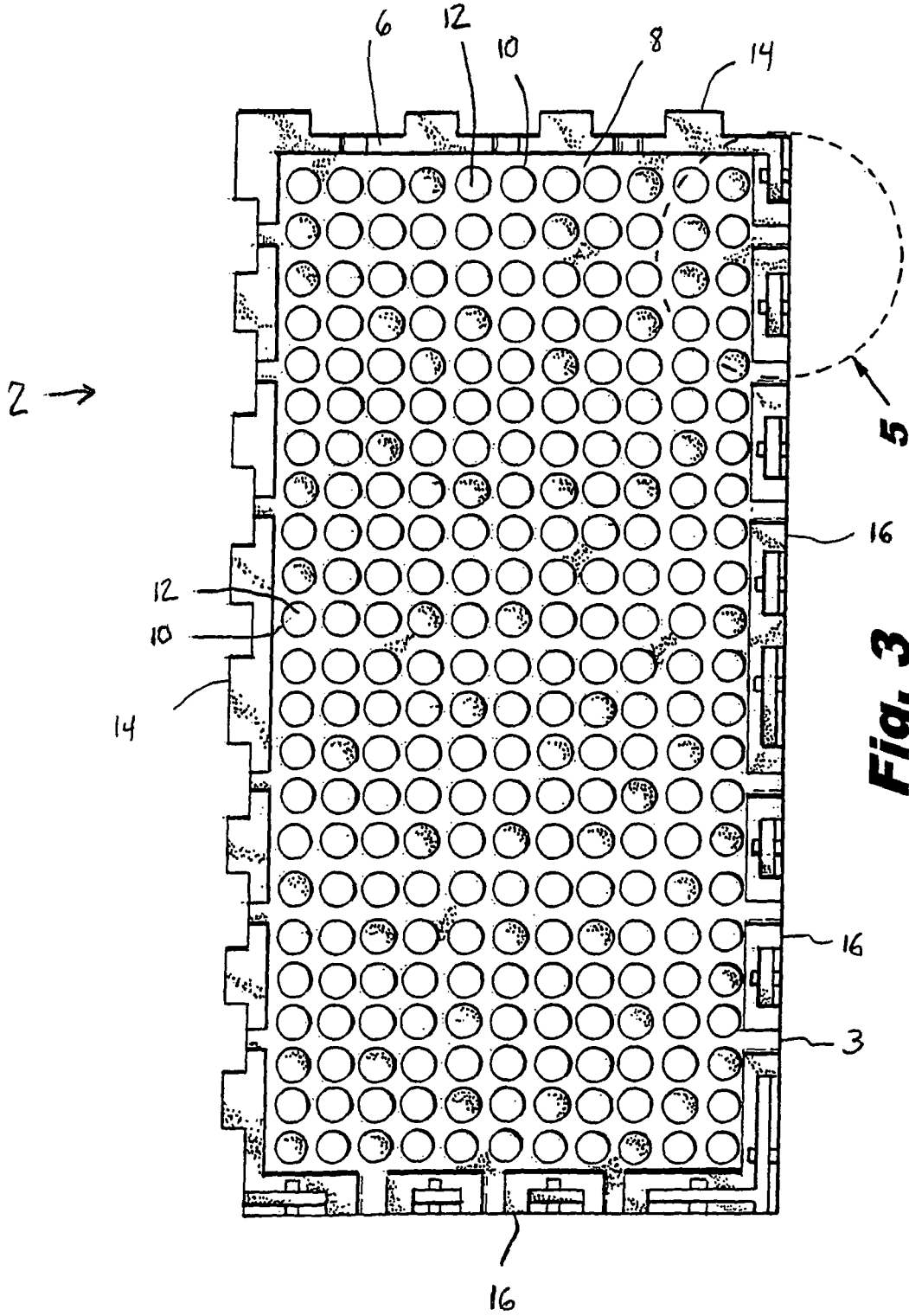
FIG. 3 is a bottom plan view of a tile formed in accordance with the present invention.
Figure 4:
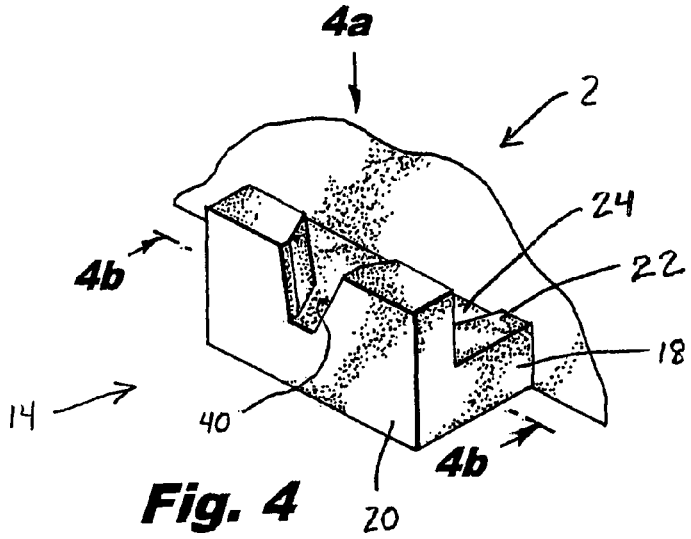
FIG. 4 is a perspective view of a portion of the tile of the present invention shown encircled in FIG. 2, and illustrating a male connector of the tile used for interlocking adjacent tiles together.
Figure 5:
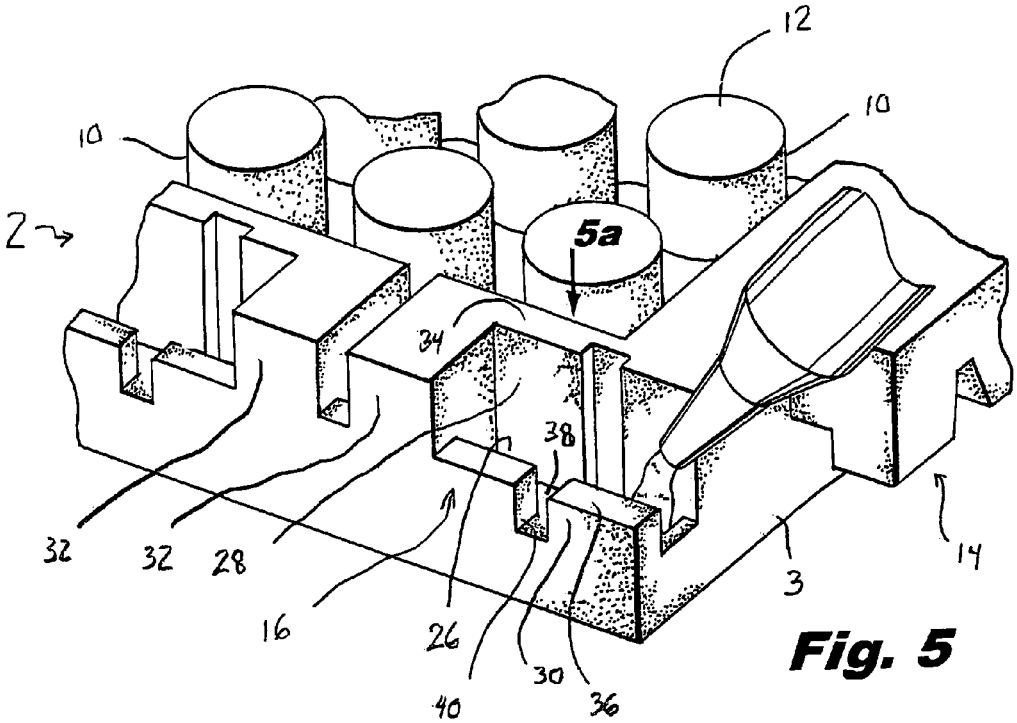
FIG. 5 is a perspective view of a portion of the underside of the tile formed in accordance with the present invention shown encircled in FIG. 3, and illustrating a female receptacle of the tile used for interlocking adjacent tiles together.
Figure 6:
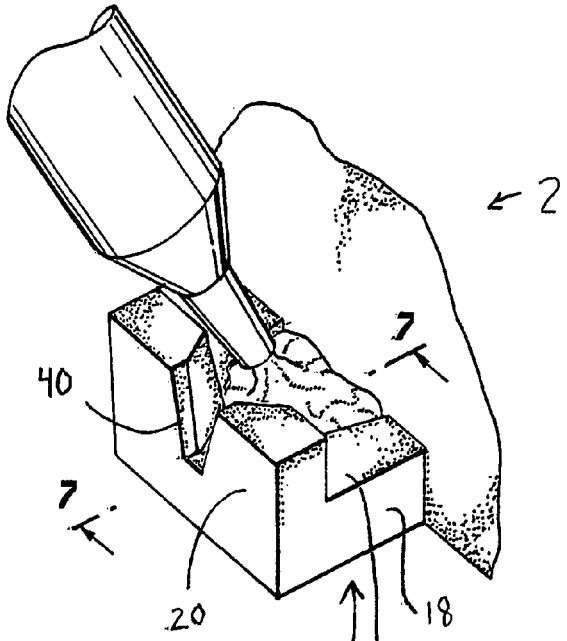
FIG. 6 is a perspective view of a portion of the tile of the present invention, and illustrating a liquid adhesive being applied to a male connector thereof.
Figure 7:
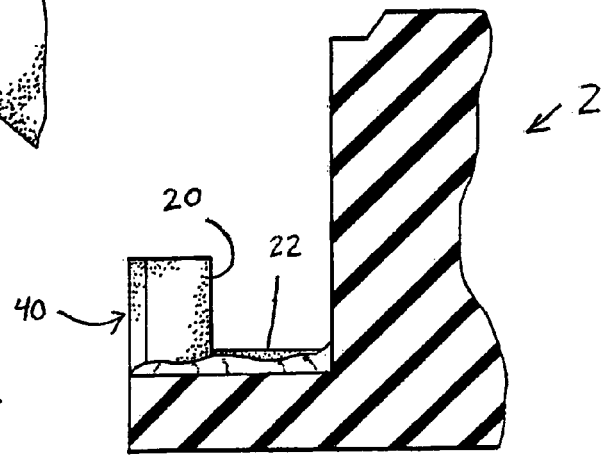
FIG. 7 is a cross-sectional view of a portion of the tile of the present invention and, in particular, the male connector of the tile, taken along line 7-7 of FIG. 6.
Figure 8:
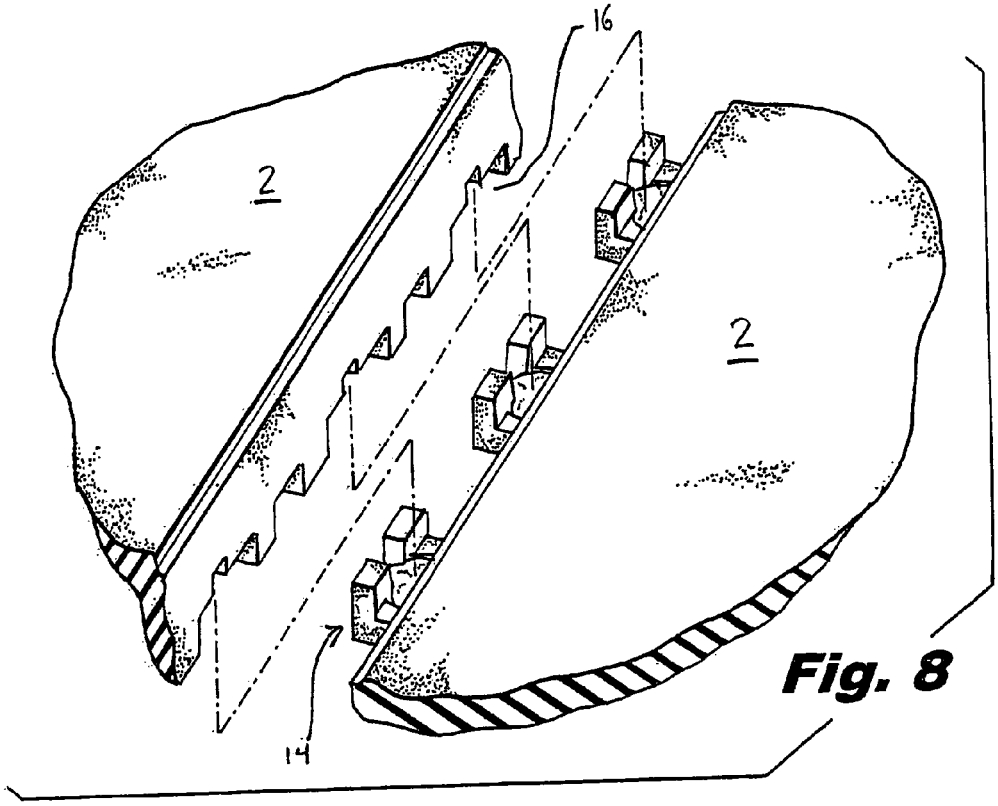
FIG. 8 is an exploded perspective view of portions of two adjacent tiles of the present invention, and illustrating the joining of the two tiles together.
Figure 9:
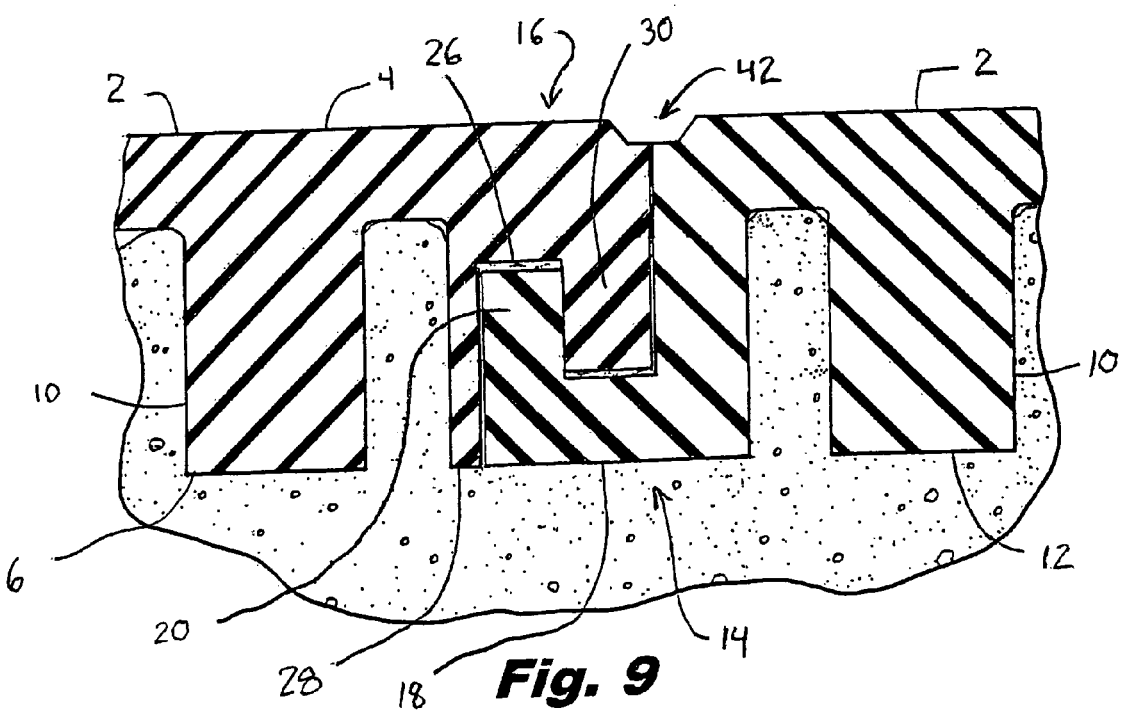
FIG. 9 is a cross-sectional view of portions of two joined together tiles of the present invention.

Referring to FIGS. 1-9 of the drawings, it will be seen that a rubber tile protective system constructed in accordance with the present invention includes a plurality of rubber tiles 2, each rubber tile 2 being interconnectable to another by a series of interlocking mechanisms integrated along the peripheral edges of each tile. The rubber tiles 2 may be selectively coupled by the interlocking mechanisms to one another to form a customizable protective surface of various proportion and size, depending on the specific application and area to be protected.

Each tile 2 may be formed in a plurality of shapes and sizes, but preferably is rectangular. The tile 2 includes a main body 3 residing generally in a plane and having a top surface 4 having a high coefficient of friction for providing sufficient traction to children and other users. The main body 3 of the tile 2 also includes an oppositely disposed bottom surface 6, the bottom surface 6 being laid on and resting on the ground or other supporting surface and having a recessed portion 8 formed therein. A plurality of cylindrical stanchions 10 extending downwardly and outwardly from the recessed portion 8, the end face 12 of each stanchion 10 being coplanar with the bottom surface 6 of the tile 2, provide gripping means to resist movement of the tile 2 when the ground surface consists of loose materials such as gravel, pebbles or shale. More specifically, when the tiles 2 are placed on a ground surface consisting of loose materials, the loose ground material may fill the recessed area around the stanchions 10 and the stanchions 10 may anchor the tile 2 in place. Each end face 12 of the stanchions 10 defines a flat bottom surface that is coplanarly aligned with the bottom surface 6 of the tile 2 to provide a large surface area to grip flat ground materials such as concrete slab.

Along the periphery of the main body 3 of the rubber tiles 2 are situated a plurality of interlocking mechanisms comprising a male connector 14 and a mating female receptacle 16. More specifically, along a first lateral side and neighboring second lateral side of the main body 3 of the tile 2 are extending outwardly therefrom a series of male connectors 14. Disposed oppositely of the male connectors 14, along a third lateral side and neighboring fourth lateral side of the main body 3, are extending outwardly therefrom a series of female receptacles 16. Individual rubber tiles 2 may be joined together by cooperatively mating the male connectors 14 on the first and second lateral side of a first tile 2 with the female receptacles 16 on the third or fourth lateral side of a second tile. To provide structural support, the tiles 2 are preferably joined together in a staggered manner, as shown in FIG. 1.

Figure 4A:
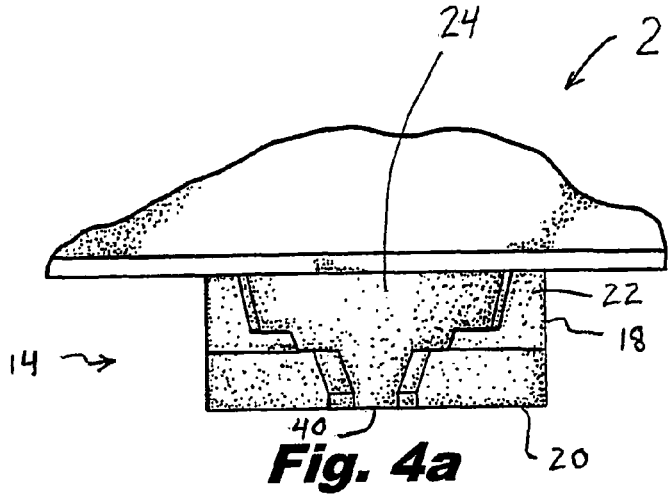
FIG. 4*a* is a top plan view of a portion of the tile of the present invention, and illustrating the male connector shown in FIG. 4.
Figure 4B:
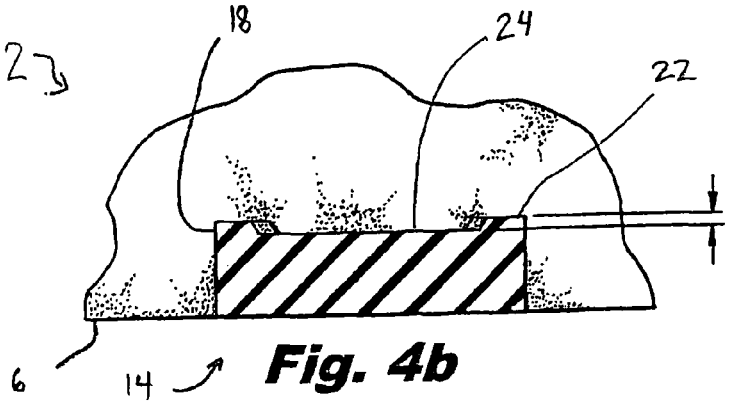
FIG. 4*b* is a cross-sectional view of a portion of the tile formed in accordance with the present invention and, in particular, the male connector thereof, taken along line 4*b*-4*b* of FIG. 4.

Now referring to FIGS. 3, 4, 4*a*, 6 and 7 of the drawings, it can be seen that each male connector 14 is formed as an L-shaped member extending perpendicularly outwardly from the side of the tile 2. The male connector 14 includes a horizontally disposed first segment 18, which extends coplanarly with the main body 3, and a vertically disposed second segment 20, the second segment 20 extending perpendicularly from the first segment 18. The first segment 18 further includes a top surface 22 having a glue reservoir 24 formed as a recess therein for receiving liquid adhesive. A plurality of male connectors 14 are preferably formed in series along the first and second sides of the tile 2, the connectors 14 preferably being equidistant from one another.

Figure 5A:
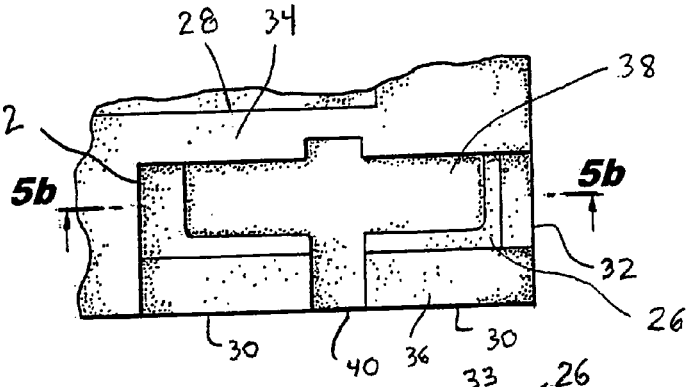
FIG. 5*a* is a top plan view of a portion of the tile of the present invention, and illustrating the female receptacle shown in FIG. 5.
Figure 5B:
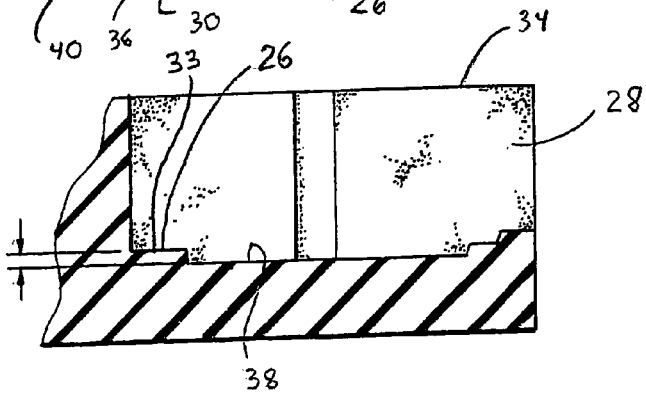
FIG. 5*b* is a cross-sectional view of a portion of the tile of the present invention, and illustrating the female receptacle of the tile, taken along line 5*b*-5*b* of FIG. 5*a*.

The female receptacles 16, as illustrated in FIGS. 3, 5, 5*a* and 5*b* of the drawings, are formed as rectangular recesses 26 within the bottom surface 6 of the tile 2, along the third and fourth sides thereof. The recesses 26 are defined by an inner wall 28, an oppositely disposed outer wall 30, two side walls 32 and a recessed surface 33. The inner wall 28 is connected to the oppositely disposed outer wall 30 by the two side walls 32, the inner wall 28 extending from the recessed portion 8 of the bottom surface 6 and terminating in an end wall 34 that is coplanar to the bottom surface 6, and the outer wall 30 extending from the recessed surface 33 of the female receptacle 16 and terminating in an end wall 36, the outer wall 30 being shorter than the inner wall 28 to accommodate and engage the horizontal first segment 18 and top surface 22 thereof of an aligned male connector 14 of an adjacent tile 2. The female receptacles 16 are preferably formed in series along the third and fourth sides of the tile 2, each female receptacle 16 preferably being positioned opposite from its corresponding male connector 14 on the first and second sides. The recesses 26 cooperatively receive the vertical second segment 20 of the male connector 14, mating the male connector 14 and the female receptacle 16 and interlocking neighboring tiles 2. The recessed surface 33 (within the recess 26) of each female receptacle 16 also has formed therein a glue reservoir 38 as a recess for receiving liquid adhesive, the glue reservoir 38 being similar in shape to the glue reservoir 24 formed in the male connector 14.

Each of the outer wall 30 of the female receptacle 16 and the vertical second segment 20 of the male connector 14 further includes a vertically disposed slot 40, which slots 40 are aligned with one another when the connector 14 is received by the receptacle 16. The vertical slot 40 of the vertical second segment 20 of the male connector 14 is in fluid communication with the glue reservoir 24 formed in the male connector 14 to allow excess adhesive filling the reservoir to flow through the vertical slot 40 from the male connector 14. Similarly, the vertical slot 40 of the outer wall 30 of the female receptacle 16 is in fluid communication with the glue reservoir 38 formed in the female receptacle 16 to allow excess adhesive filling the reservoir 38 to flow through the vertical slot 40 from the female receptacle 16.

Prior to interlocking two neighboring tiles 2, a liquid adhesive is applied to one or both of the horizontal first segment 18 and/or glue reservoir 24 of each male connector 14 and the recess 26 and/or glue reservoir 38 of each female receptacle 16. As the aligned male connector 14 and female receptacle 16 of adjacent tiles 2 are mated and pressure is applied, the aligned vertical slots 40 in the outer wall 30 of the female receptacle 16 and the vertical second segment 20 of the male connector 14 create a channel for excess adhesive to exit the glue reservoirs 24, 38 of the male connectors 14 and female receptacles 16 and the sides of the joined together tiles 2. The adhesive secures the vertical second segment 20 of the male connector 14 within the recess 26 of the female receptacle 16 and preferably secures the top surface 22 of the horizontal first segment 18 of the male connector 14 to the end wall 36 of the outer wall 30 of the female receptacle 16.

The top surface 4 of each tile 2 preferably further includes a plurality of water channels 42. The water channels 42 are preferably formed as chamfers along the top peripheral edges of the tile 2. As neighboring tiles 2 are interlocked, their facing peripheral chamfered edges create such a recess or channel 42 that allows water to run off the top surface 4 of the tile 2 into the channel 42, minimizing water pooling. Additional water channels 44 may be formed as elongated recesses in the top surface 4, each being in fluid communication with an aforementioned peripheral water channel 42.

It is also envisioned to be within the scope of the present invention to fasten the tiles 2 to a supporting surface, such as asphalt or wood, by using screws or other fasteners which pass through the thickness of the male connectors 14 preferably at the horizontal first segments 18 thereof and into the supporting surface, with or without the use of liquid adhesive between mating tiles 2.

The tiles may be formed from reprocessed or recycled rubber, for example, from shredded or pulverized rubber automobile tires. In another form of the present invention, a top layer or portion of each tile may be formed from shredded or pulverized white, gray or yellow (i.e., light colored) rubber tires, such as those found on forklifts and other rubber wheeled equipment. This lighter colored top layer of the tile may be about one-half (½) inch in thickness, and the remainder bottom portion of the tile may be black and made from shredded or pulverized conventional black walled automobile tires. Tiles formed with such a lighter colored top layer may be about twenty percent (20%) cooler, or more, on its top surface than tiles formed completely from conventional black walled automobile tires.

The interlocking rubber tiles are described herein as being particularly useful for playgrounds. However, it should be realized that the tiles have many different uses, including, for example, for covering rooftop surfaces and other athletic and recreational surfaces.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A tile for covering an area and which interlocks with an adjacent tile, which comprises:

a main body having a top surface and a bottom surface disposed opposite the top surface, the main body having at least a first lateral side and a second lateral side;

at least one male connector situated on at least one of the first lateral side and the second lateral side of the main body and extending outwardly therefrom; and at least one female receptacle situated on at least one of the first lateral side and the second lateral side of the main body;

wherein the male connector of the tile is engageable with a female receptacle of an adjacent tile so that the tile may interlock with the adjacent tile;

wherein the main body of the tile resides generally in a plane;

wherein the male connector includes a first segment extending outwardly from the main body co-planarly with the main body, and a second segment joined to the first segment and extending perpendicularly to the first segment;

and wherein the female receptacle includes an inner wall, an outer wall disposed opposite the inner wall, sidewalls interposed between the inner wall and the outer wall, and a recessed bottom wall, the inner wall, outer wall, sidewalls and bottom wall of the female receptacle defining a recess for at least partially receiving the second segment of the male connector of an adjacent tile to interlock the tile with the adjacent tile.

2. A tile for covering an area and which interlocks with an adjacent tile as defined by claim 1, wherein at least one of the male connector and the female receptacle includes structure defining a reservoir for containing an adhesive for adhesively securing the tile and an adjacent tile together.

3. A tile for covering an area and which interlocks with an adjacent tile as defined by claim 2, wherein the at least one of the male connector and the female receptacle having the structure defining a reservoir further includes structure defining a slot, the slot being in communication with the reservoir to allow excess adhesive to flow from the reservoir therethrough.

4. A tile for covering an area and which interlocks with an adjacent tile as defined by claim 1, wherein the first segment of the male connector has formed therein a glue reservoir for receiving a glue for adhesively joining the tile to an adjacent tile.

5. A tile for covering an area and which interlocks with an adjacent tile as defined by claim 4, wherein the second segment of the male connector has formed therein a slot, the slot being in communication with the glue reservoir formed in the first segment of the male connector to allow excess glue to flow from the glue reservoir of the male connector therethrough.

6. A tile for covering an area and which interlocks with an adjacent tile as defined by claim 1, wherein the female receptacle defines a glue reservoir for receiving a glue for adhesively joining the tile to an adjacent tile.

7. A tile for covering an area and which interlocks with an adjacent tile as defined by claim 6, wherein the glue reservoir of the female receptacle is formed in the recessed bottom surface.

8. A tile for covering an area and which interlocks with an adjacent tile as defined by claim 6, wherein the outer wall of the female receptacle has formed therein a slot, the slot being in communication with the glue reservoir formed in the female receptacle to allow excess glue to flow from the glue reservoir of the female receptacle therethrough.

9. A tile for covering an area and which interlocks with an adjacent tile as defined by claim 1, wherein the first segment of the male connector has formed therein a glue reservoir for receiving a glue for adhesively joining the tile to an adjacent tile;

and wherein the female receptacle defines a glue reservoir for receiving a glue for adhesively joining the tile to an adjacent tile.

10. A tile for covering an area and which interlocks with an adjacent tile as defined by claim 1, wherein the top surface of the main body of the tile has formed therein at least one recess, the at least one recess defining a water channel through which water may flow.

11. A tile for covering an area and which interlocks with an adjacent tile as defined by claim 1, wherein the main body of the tile includes peripheral edges situated at the top surface thereof, the peripheral edges being beveled to form chamfers, the chamfer of one peripheral edge of the tile being situated in parallel with and adjacent to the chamfer of a peripheral edge of an adjacent tile so as to define together a water channel through which water may flow.

* * * * *